US010471573B2

(12) United States Patent
Howard et al.

(10) Patent No.: US 10,471,573 B2
(45) Date of Patent: Nov. 12, 2019

(54) IMPACT TOOL

(71) Applicant: Milwaukee Electric Tool Corporation, Brookfield, WI (US)

(72) Inventors: James B. Howard, Pewaukee, WI (US); Jacob P. Schneider, Madison, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 371 days.

(21) Appl. No.: 15/384,888

(22) Filed: Dec. 20, 2016

(65) Prior Publication Data

US 2017/0190028 A1 Jul. 6, 2017

Related U.S. Application Data

(60) Provisional application No. 62/274,877, filed on Jan. 5, 2016.

(51) Int. Cl.
*B25B 21/02* (2006.01)

(52) U.S. Cl.
CPC ..... *B25B 21/026* (2013.01)

(58) Field of Classification Search
CPC ..... B25B 21/026
USPC ..... 173/90
See application file for complete search history.

(56) References Cited

U.S. PATENT DOCUMENTS

| | | | | |
|---|---|---|---|---|
| 3,759,334 | A | 9/1973 | Theurer | |
| 4,313,505 | A | 2/1982 | Silvern | |
| 4,609,053 | A | 9/1986 | Ragnmark | |
| 6,491,111 | B1 | 12/2002 | Livingston et al. | |
| 6,592,597 | B2 * | 7/2003 | Grant | A61B 17/072 227/175.1 |
| 7,124,839 | B2 | 10/2006 | Furuta et al. | |
| 7,308,948 | B2 | 12/2007 | Furuta | |
| 7,416,031 | B2 | 8/2008 | Murakami et al. | |
| 8,047,057 | B2 | 11/2011 | Chen | |
| 8,490,714 | B2 | 7/2013 | Nakamura | |
| 9,114,514 | B2 | 8/2015 | Leong et al. | |
| 2001/0010268 | A1 | 8/2001 | Tokunaga et al. | |
| 2005/0199404 | A1 * | 9/2005 | Furuta | B25B 21/00 173/48 |
| 2006/0090913 | A1 * | 5/2006 | Furuta | B25B 21/00 173/48 |
| 2007/0000675 | A1 * | 1/2007 | Sell | B25D 11/005 173/90 |
| 2010/0000749 | A1 * | 1/2010 | Andel | B25B 21/02 173/48 |
| 2010/0025063 | A1 | 2/2010 | Kuhnapfel et al. | |

(Continued)

FOREIGN PATENT DOCUMENTS

JP 20070152448 6/2007

*Primary Examiner* — Hemant Desai
*Assistant Examiner* — Christopher Robin Kim
(74) *Attorney, Agent, or Firm* — Michael Best Friedrich LLP

(57) ABSTRACT

An impact tool includes a housing, a motor supported in the housing, and a drive assembly for converting a continuous torque input from the motor to consecutive rotational impacts upon a workpiece. The drive assembly includes an anvil, a hammer that is both rotationally and axially movable relative to the anvil, and a spring for biasing the hammer in an axial direction toward the anvil. The spring is rotationally unitized to the hammer for co-rotation therewith at all times during operation of the impact tool.

18 Claims, 4 Drawing Sheets

(56) References Cited

U.S. PATENT DOCUMENTS

2010/0071923 A1* 3/2010 Rudolph ..... B25B 21/00 173/48
2010/0319945 A1* 12/2010 Chen ..... B23B 45/008 173/48
2010/0326686 A1* 12/2010 Leong ..... B25B 21/00 173/48
2011/0120739 A1* 5/2011 Chen ..... B25C 1/06 173/90
2012/0111592 A1* 5/2012 Limberg ..... B25B 21/026 173/48
2012/0152577 A1* 6/2012 Mattson ..... B25D 17/02 173/1
2012/0318548 A1 12/2012 Hirabayashi et al.
2013/0087355 A1* 4/2013 Oomori ..... B25B 21/00 173/47
2013/0112448 A1* 5/2013 Profunser ..... B25B 21/026 173/93.5
2013/0161044 A1* 6/2013 Hecht ..... B23B 31/1238 173/90
2013/0264087 A1* 10/2013 Harada ..... B25B 21/00 173/213
2014/0008089 A1 1/2014 Yeoh et al.
2014/0338945 A1* 11/2014 Herr ..... B25D 11/104 173/94
2014/0367132 A1* 12/2014 Tanaka ..... B25B 21/026 173/93
2015/0014009 A1 1/2015 Staas et al.
2015/0041169 A1* 2/2015 Kumagai ..... B25B 21/026 173/93.7
2015/0158155 A1 6/2015 Tsubakimoto
2016/0075004 A1* 3/2016 Tsubakimoto ..... B25B 21/02 173/93
2016/0193726 A1* 7/2016 Rompel ..... B25D 11/068 173/93.5
2016/0250738 A1* 9/2016 Leh ..... B25B 21/02 173/176

* cited by examiner

IMPACT TOOL

CROSS-REFERENCE TO RELATED APPLICATIONS

This application claims priority to U.S. Provisional Patent Application No. 62/274,877, filed on Jan. 5, 2016, the entire contents of which are incorporated herein by reference.

FIELD OF THE INVENTION

The present invention relates to power tools, and more specifically to impact tools.

BACKGROUND OF THE INVENTION

Impact tools or wrenches are typically utilized to provide a striking rotational force, or intermittent applications of torque, to a tool element or workpiece (e.g., a fastener) to either tighten or loosen the fastener. As such, impact wrenches are typically used to loosen or remove stuck fasteners (e.g., an automobile lug nut on an axle stud) that are otherwise not removable or very difficult to remove using hand tools.

SUMMARY OF THE INVENTION

The invention provides, in one aspect, an impact tool including a housing, a motor supported in the housing, and a drive assembly for converting a continuous torque input from the motor to consecutive rotational impacts upon a workpiece. The drive assembly includes an anvil, a hammer that is both rotationally and axially movable relative to the anvil, and a spring for biasing the hammer in an axial direction toward the anvil. The spring is rotationally unitized to the hammer for co-rotation therewith at all times during operation of the impact tool.

The invention provides, in another aspect, an impact tool including a housing, a motor supported in the housing, and a drive assembly for converting a continuous torque input from the motor to consecutive rotational impacts upon a workpiece. The drive assembly includes an anvil, a hammer that is both rotationally and axially movable relative to the anvil, and a spring for biasing the hammer in an axial direction toward the anvil. The drive assembly further includes a tab on one of the spring or the hammer, and a corresponding groove on the other of the spring or the hammer into which the tab is received for rotationally unitizing the spring to the hammer.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
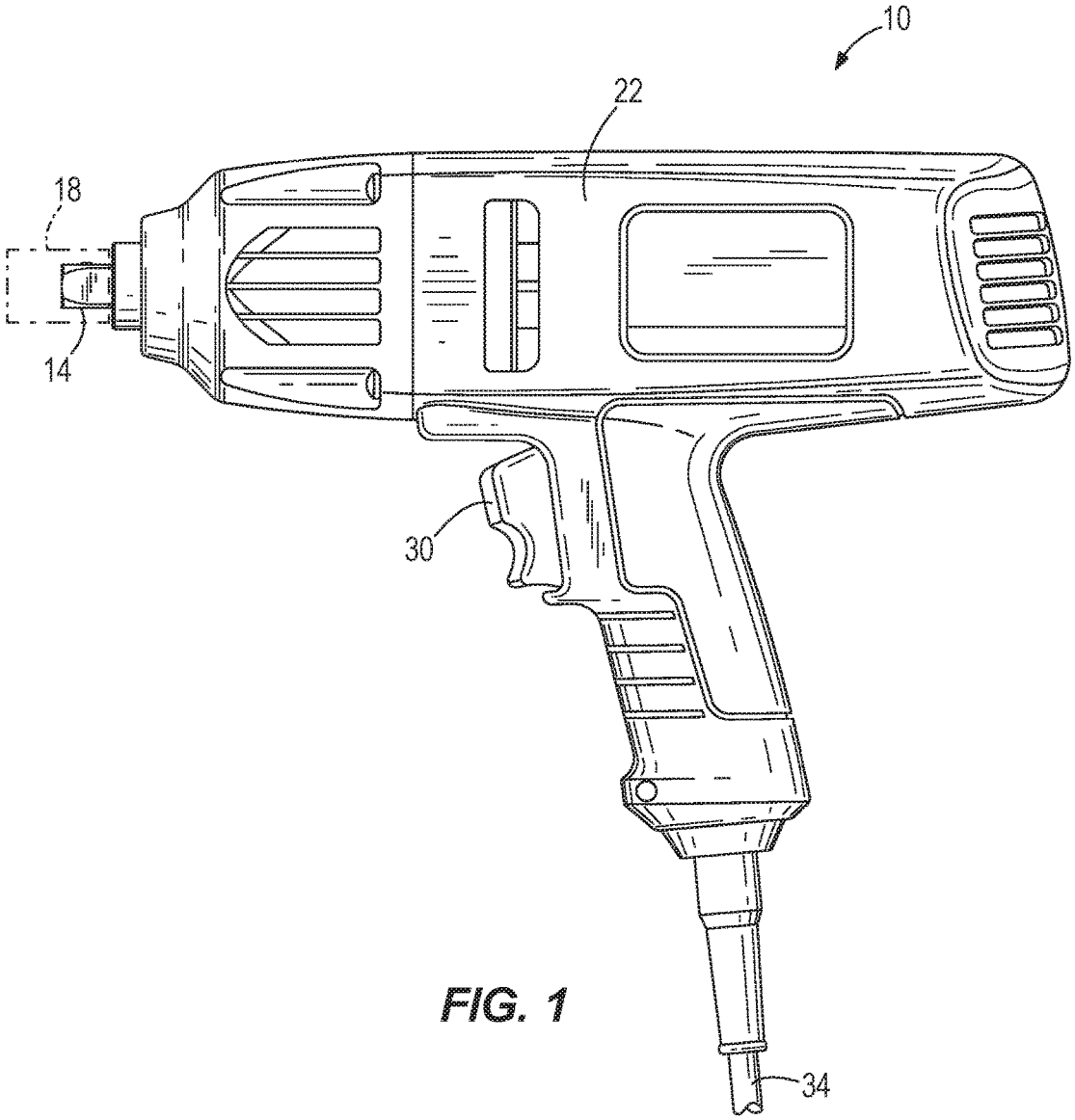
FIG. 1 is a side view of a conventional impact wrench.
Figure 2:
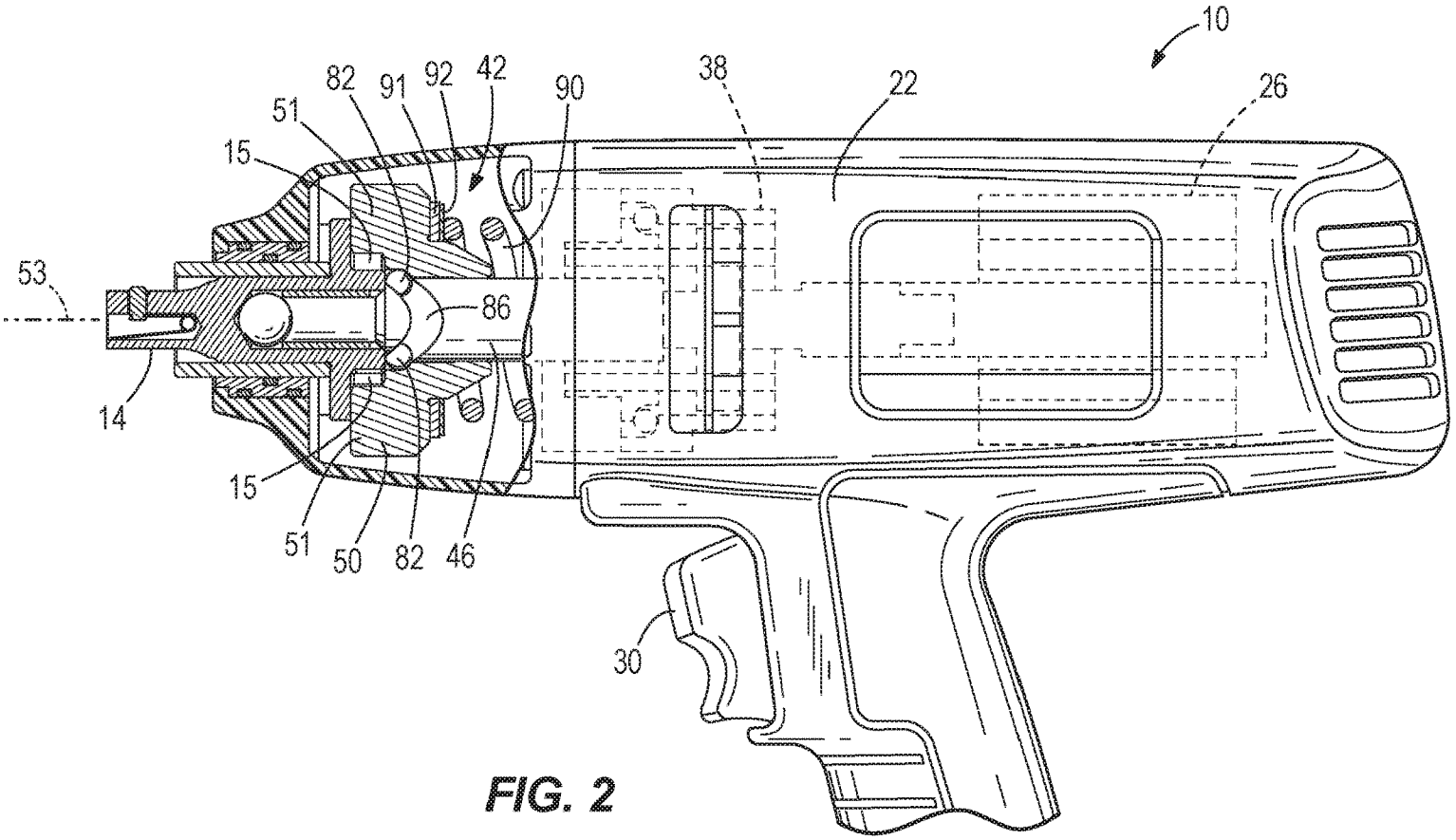
FIG. 2 is a partial cutaway view of the impact wrench of FIG. 1, illustrating a conventional drive assembly in cross-section.

FIG. 1 illustrates an impact wrench 10 including an anvil 14 and a tool element 18 coupled to the anvil 14. Although the tool element 18 is schematically illustrated, the tool element 18 may include a socket configured to engage the head of the fastener (e.g., a bolt). Alternatively, the tool element 18 may include any of a number of different configurations (e.g., an auger or a drill bit) to perform work on a workpiece. With reference to FIGS. 1 and 2, the impact wrench 10 includes a housing 22 and a reversible electric motor 26 coupled to the anvil 14 to provide torque to the anvil 14 and the tool element 18. The impact wrench 10 also includes a switch (e.g., trigger switch 30) supported by the housing 22 and a power cord 34 extending from the housing 22 for electrically connecting the switch 30 and the motor 26 to a source of AC power. Alternatively, the impact wrench 10 may include a battery, and the motor 26 may be configured to operate on DC power provided by the battery. As a further alternative, the impact wrench 10 may be configured to operate using a different power source (e.g., a pneumatic or hydraulic power source, etc.) besides electricity.

With reference to FIG. 2, the impact wrench 10 also includes a gear assembly 38 coupled to an output of the motor 26 and a drive assembly 42 coupled to an output of the gear assembly 38. The gear assembly 38 may be configured in any of a number of different ways to provide a speed reduction between the output of the motor 26 and an input of the drive assembly 42. The drive assembly 42, of which the anvil 14 may be considered a component, is configured to convert the constant rotational force or torque provided by the gear assembly 38 to a striking rotational force or intermittent applications of torque to the tool element 18 when the reaction torque on the tool element 18 (exerted by the fastener being worked upon) exceeds a predetermined threshold. In the illustrated embodiment of the impact wrench 10, the drive assembly 42 includes a camshaft 46 coupled to and driven by the gear assembly 38, a hammer 50 supported on and axially slidable relative to the camshaft 46, and the anvil 14. U.S. Pat. Nos. 6,733,414; 8,839,879; and 8,505,648, the entire contents of which are incorporated herein by reference, discloses in detail example configurations of the gear assembly 38, and the structure and operation of the camshaft 46 and the hammer 50.

With continued reference to FIG. 2, the drive assembly 42 further includes a spring 90 biasing the hammer 50 toward the front of the tool (i.e., in the left direction of FIG. 2). In other words, the spring 90 biases the hammer 50 in an axial direction toward the anvil 14, along an axis 53 defined by the hammer 50. A thrust bearing 91 and a thrust washer 92 are positioned between the spring 90 and the hammer 50. The thrust bearing 91 and the thrust washer 92 allow for the spring 90 and the camshaft 46 to continue to rotate relative to the hammer 50 after each impact strike when hammer lugs 51 engage with corresponding anvil lugs 15 and rotation of the hammer 50 momentarily stops. In other words, provided the spring 90 is sufficiently preloaded, the spring 90 co-rotates with the camshaft 46 during operation since relative rotation is permitted at the interface of the spring 90 and the hammer 50 by the thrust bearing 91. The camshaft 46 further includes cam grooves 86 in which corresponding cam balls 82 are received. As described in greater detail below regarding the operation of the impact wrench 10, the cam balls 82 are in driving engagement with the hammer 50 and movement of the cam balls 82 within the cam grooves 86 allows for relative axial movement of the hammer 50 along the camshaft 46 when the hammer lugs 51 and the anvil lugs 15 are engaged and the camshaft 46 continues to rotate.

In operation of the impact wrench 10 in a forward or clockwise direction of rotation, an operator depresses the switch 30 to electrically connect the motor 26 with a source of power to activate the motor 26, which continuously drives the gear assembly 38 and the camshaft 46. The cam balls 82 drive the hammer 50 to co-rotate with the camshaft 46, and the drive surfaces of hammer lugs 51 engage, respectively, the driven surfaces of anvil lugs 15 to provide an impact and to rotatably drive the anvil 14 and the tool element 18 in the selected clockwise or forward direction. After each impact, the hammer 50 moves or slides rearwardly along the camshaft 46 (i.e., along the axis 53), away from the anvil 14, so that the hammer lugs 51 disengage the anvil lugs 15. As the hammer 50 moves rearwardly, the cam balls 82 situated in the respective cam grooves 86 in the camshaft 46 move rearwardly in the cam grooves 86. The spring 90 stores some of the rearward energy of the hammer 50 to provide a return mechanism for the hammer 50. While the hammer 50 is seized against the anvil 14 (i.e., not rotating), the spring 90 and the camshaft 46 continue to rotate. Relative rotation between the spring 90 and the hammer 50 is provided by the thrust bearing 91 and the thrust washer 92. After the hammer lugs 51 disengage the respective anvil lugs 15, the hammer 50 continues to rotate and moves or slides forwardly, toward the anvil 14, as the spring 90 releases its stored energy, until the drive surfaces of the hammer lugs 51 re-engage the driven surfaces of the anvil lugs 15 to cause another impact.

The rotational kinetic energy of the drive assembly 42 is directly proportional to the moment of inertias of the impacting bodies (e.g., the hammer 50). Increasing the moment of inertia of the hammer 50 increases the rotational kinetic energy of the drive assembly 42, but also causes the impact tool 10 to become heavier and larger in size, which degrades the user experience. Alternatively, reducing the impact mechanism size and weight for an improved user experience sacrifices the torque capability of the impact tool.

Figure 3:
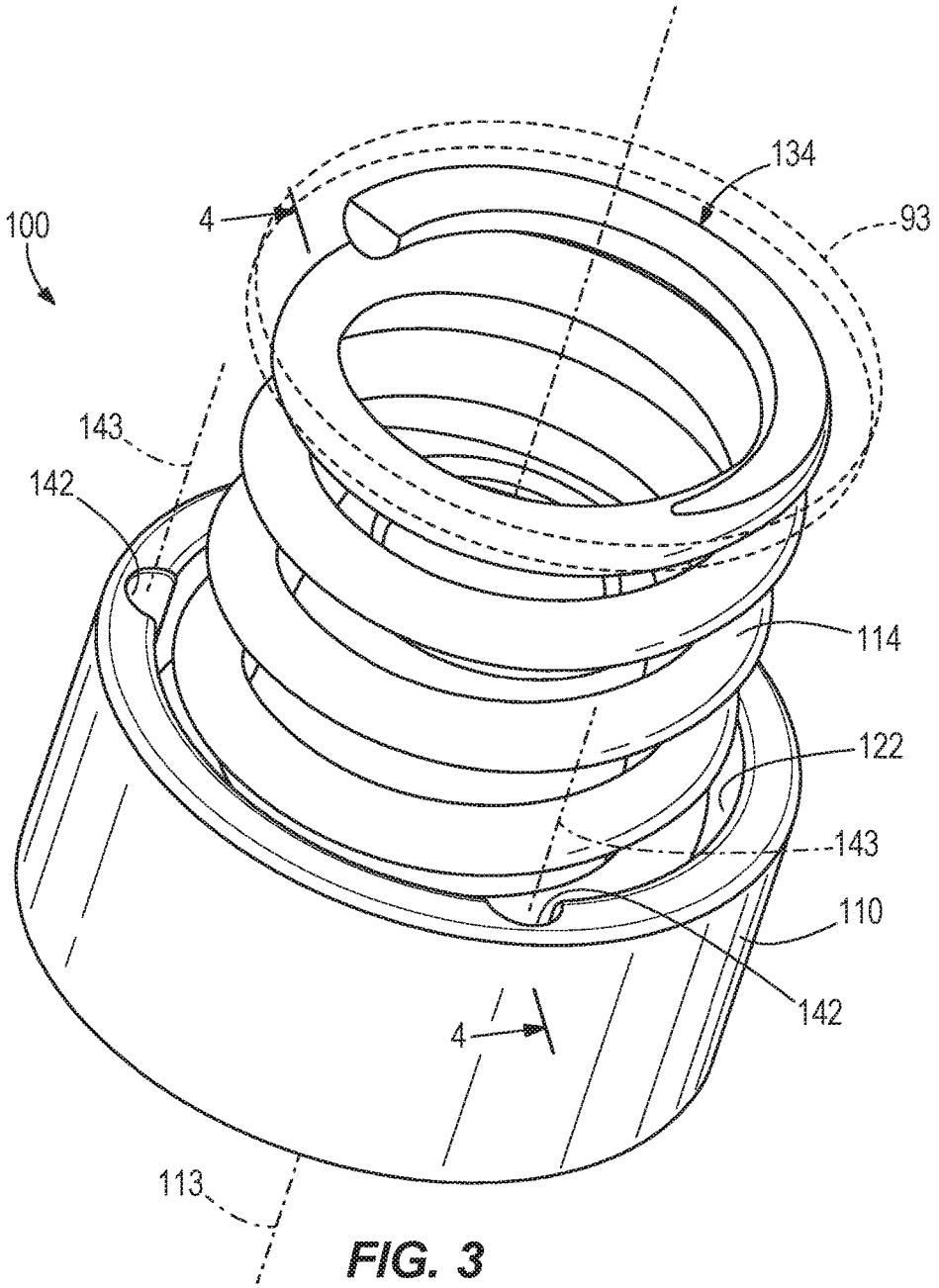
FIG. 3 is a perspective view of a portion of a drive assembly according to the invention, illustrating a hammer and a spring, for use in the impact wrench of FIG. 1.
Figure 4:
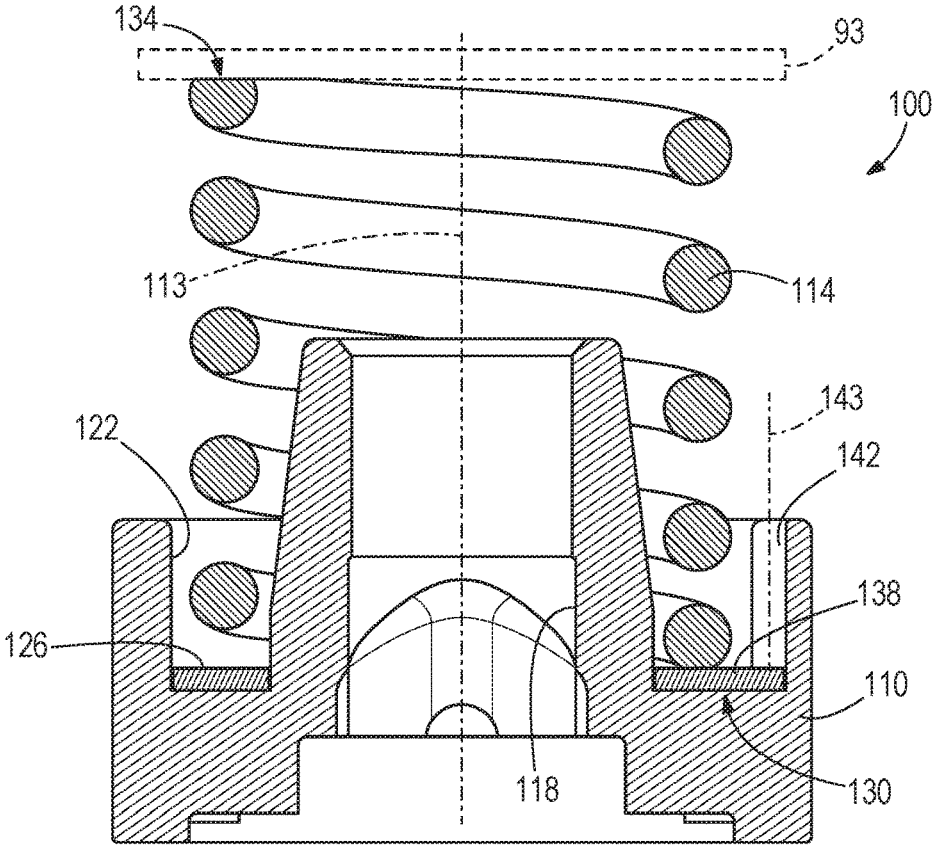
FIG. 4 is cross-sectional view of the portion of the drive assembly in FIG. 3 taken along the section line 4-4 shown in FIG. 3.
Figure 5:
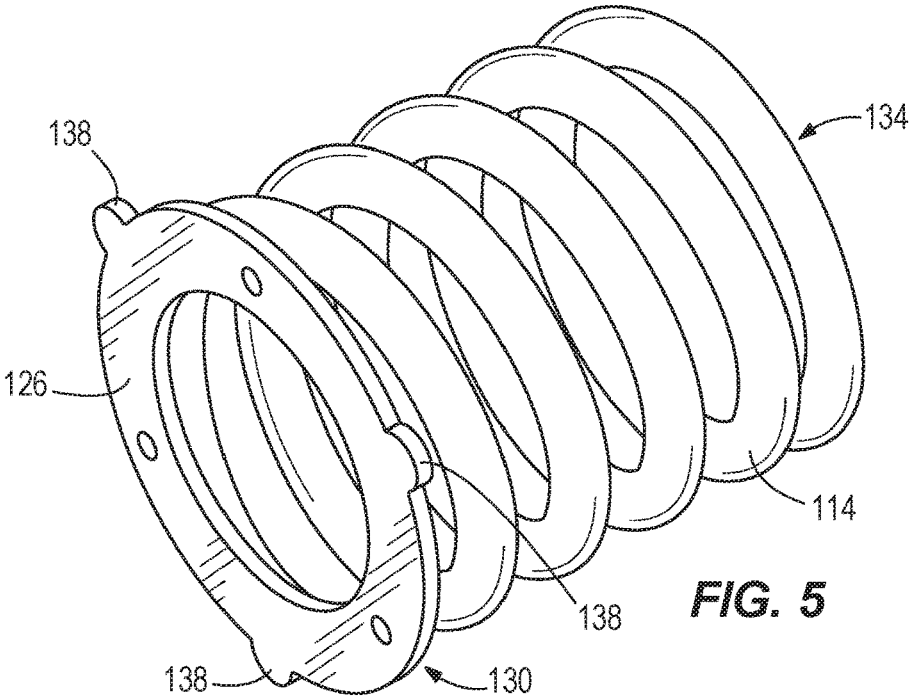
FIG. 5 is a perspective view of the spring of FIG. 3.

FIGS. 3-5 illustrate a portion of an improved drive assembly 100 according to one embodiment of the invention for use in the impact wrench 10 of FIGS. 1 and 2. The drive assembly 100 includes a hammer 110 and a spring 114, which are intended to replace the hammer 50 and the spring 90 of the conventional drive assembly 42 described above and shown in FIGS. 1 and 2. According to the present invention, the spring 114 is rotationally unitized to the hammer 110 for co-rotation therewith at all times during operation of the impact wrench 10, thus increasing the effective moment of inertia of the hammer 110 without increasing the size or weight of the hammer 110.

In the illustrated embodiment, the hammer 110 includes a central bore 118 in which a cam shaft (i.e., the camshaft 46 of FIG. 2) is at least partially received (FIGS. 2 and 3). The hammer 110 defines an axis 113 about which the hammer 110 rotates and along which the hammer 110 translates. The hammer 110 further includes a recess 122 in which the spring 114 is partially received. With reference to FIG. 5, the spring 114 includes an annular plate 126 secured (e.g., by welding) to a first or forward end 130 of the spring 114. A second or rearward end 134 of the spring 114 is machined, or otherwise formed, to be a flat surface. The annular plate 126 includes three equally spaced, radially outward extending tabs 138. The hammer 110 further includes three equally spaced axial grooves 142 in which the tabs 138 are slidably received to rotationally unitize the hammer 110, the plate 126, and the spring 114. The grooves 142 each define a longitudinal axis 143 that extends parallel with the rotational axis 113 of the hammer 110. In an alternative embodiment of the drive assembly 100, the tabs 138 may be machined or otherwise integrally formed with the spring 114 rather than providing the tabs 138 separately with the plate 126, thereby omitting the plate. In yet another alternative, the tabs 138 may be incorporated on the hammer 110 and the grooves 142 may be defined in the plate 126. In yet another alternative, more or less than three tabs 138 and corresponding grooves 142 may be utilized (e.g., one tab and one groove, four tabs and four grooves, etc.).

A combination of a thrust bearing and a thrust washer (collectively identified with reference numeral "93" in FIGS. 3 and 4), which are similar to the thrust bearing 91 and thrust washer 92 of FIG. 2, are positioned between the flat second end 134 of the spring 114 and the camshaft to permit relative rotation between the camshaft and a combination of the hammer 110 and spring 114 between impacts, as explained in greater detail below.

The operation of the hammer 110 and the spring 114 according to the present invention will now be described with only the differences in operation from that described above with respect to the conventional impact wrench 10 described in detail below. At the moment of impact between the hammer 110 and the anvil 14, both the hammer 110 and the spring 114 momentarily seize due to the reaction torque applied by the anvil 14 to the hammer 110. In contrast, in the conventional drive assembly 42, the spring 90 continues to rotate with the camshaft 46 relative to the hammer 50 as a result of the thrust bearing 91 between the hammer 50 and the spring 90. After each impact, the hammer 110 moves or slides rearward along the camshaft 46, against the bias of the spring 114 and away from the anvil 14, so that the hammer lugs may disengage the anvil lugs. As the hammer 110 slides rearward along the camshaft 46, the spring 114 and the hammer 110 remain rotationally locked together. After the hammer lugs disengage the respective anvil lugs, the hammer 110 and the spring 114 continue to rotate and move or slide forwardly, toward the anvil 14, as the spring 114 releases its stored energy, until the drive surfaces of the hammer lugs re-engage the driven surfaces of the anvil lugs to cause another impact. In other words, the spring 114 is rotationally unitized to the hammer 110 for co-rotation therewith at all times during operation of the impact tool.

By rotationally unitizing the hammer 110 and the spring 114 in the drive assembly 100 as described above, the effective moment of inertia of the hammer 110 can be expressed as the summation of the individual moments of inertia of the hammer 110 and the spring 114. By arranging the drive assembly 100 in this manner, in one embodiment, the effective moment of inertia of the hammer 110 increased from $2.45\times10^{-4}$ kg-m$^2$ to $3.18\times10^{-4}$ kg-m$^2$, which is an increase of 29.8%. This increase in the effective moment of inertia of the hammer 110 comes without sacrificing the size or mass characteristics of the hammer 110 because the spring 114 is a pre-existing component in the drive assembly 100. In other words, the moment of inertia of the spring 114 is added to the tool output system (i.e., the hammer 110) instead of being added to the input system (i.e., the motor 26 and camshaft 46). The increase in the effective moment of inertia of the hammer 110 increases the output torque potential without adding additional weight or size to the drive assembly 100 (compared to the conventional drive assembly 42 of FIG. 2).

With reference to Tables 1-3, experimental and simulated characteristics of an impact wrench incorporating the drive assembly 100 of the invention can be compared to conventional impact wrenches using the conventional drive assembly 42 of FIG. 2. Table 1 shows the results comparing various simulations, the current generation of impact wrenches ("Gen. I") and the present invention ("Gen. II"), and the effects of socket characteristics. The "Matlab/SimMechanics" columns in Table 1 list the results of a simulation conducted over a two second period based upon solid models of the respective drive assemblies 42, 100. The "Excel" columns in Table 1 list the results of a second simulation based upon mathematical models of the respective drive assemblies 42, 100. Table 1 illustrates how the drive assembly 100 of the invention increases torque output of the impact wrench in which it is incorporated by 7.34% over a conventional drive assembly, such as the drive assembly 42 of FIG. 2. But, this increase in torque also increases the current draw of the electric motor.

TABLE 1

| | Matlab/SimMechanics (2s) | | | | | Excel | |
|---|---|---|---|---|---|---|---|
| | Perfect Socket | | | | | | |
| | Impact Energy [J] | Internal Torque [ft-lb] | Output Torque [ft-lb] | Torque Increase | Current Draw [A] | Impact Energy [J] | Current Draw [A] |
| 2763-Gen. I | 16.88 | 737.9 | 655.5 | 7.34% | 62.4347 | 15.91 | 60.794 |
| 2763-Gen. II | 20.2 | 792.1 | 703.6 | | 71.1528 | 18.22 | 71.558 |

Table 2 lists the results of simulations conducted over a six second period based upon solid models of the conventional drive assembly 42 ("Gen. I") and the drive assembly 100 of the present invention ("Gen. II"). Table 2 also lists the actual results of experimental testing of conventional impact wrenches using the drive assembly 42. The simulated output torque of the conventional design of 977.5 ft-lbs is within 4% of the measured experimental output torque of 1013 ft-lbs, thereby providing confidence in the simulated output torque result of 1150 ft-lbs for the drive assembly 100 of the present invention ("Gen. II").

TABLE 2

| | Matlab Simulation (6s) | | | | Actual | |
|---|---|---|---|---|---|---|
| | Impact Energy [J] | Internal Torque [ft-lb] | Output Torque [ft-lb] | Current Draw | Output Torque [ft-lb] | Current Draw [A] |
| Gen. I *Same Motor as Gen. I, only change is hammer assembly | 18.47 | 907.5 | 977.5 | 65.511 | 1013 | N/A |
| Gen. II | 21.66 | 957.3 | 1150 | 73.9342 | N/A | N/A |

Table 3 shows the characteristics of different motor types used in conjunction with both a conventional drive assembly, such as the drive assembly 42 of FIG. 2, and the drive assembly 100 of the present invention ("Gen. II"). For example, the first row of Table 3 ("BL50-10.5") illustrates the simulated results with the conventional drive assembly 42 and a smaller motor (i.e., 60 mm diameter motor to a 50 mm diameter motor), and the second row of Table 3 ("BL50-10.5-Gen. II") illustrates how the design in the first row could be improved with the invention. In one embodiment, the conventional impact wrench produces 1083 ft-lbs of torque, while the drive assembly 100 produces 1480 ft-lbs of torque (a 37% increase). This increase in torque is substantial but also results in an increase in the current draw of the motor, which can be mitigated by using a motor optimized to draw less current with better power characteristics than what would otherwise be used in a conventional electric impact wrench.

TABLE 3

| | Matlab/SimMechanics (2s) Perfect Socket | | | | | Excel | | | |
|---|---|---|---|---|---|---|---|---|---|
| | Impact Energy [J] | Internal Torque [ft-lb] | Output Torque [ft-lb] | Torque Change From Gen I (655 ft-lbs) | Current Draw [A] | Impact Energy [J] | Current Draw [A] | Impact Height (mm) | Spring Preload (N) |
| BL50-10.5 | 17.83 | 760 | 676.4 | +3.27% | 48.5222 | 16.76 | 48.908 | 1.046 | 390 |
| BL50-10.5-Gen. II | 21.35 | 887.5 | 821.5 | +25.35% | 55.0462 | 19.10 | 54.026 | 1.073 | 495 |
| BL50-9.5 | 20.5 | 868.1 | 795 | +21.37% | 61.1714 | 19.06 | 58.393 | 1.037 | 505 |
| BL50-9.5-Gen. II | 23.83 | 881.1 | 786.9 | +20.14% | 68.4303 | 21.41 | 67.094 | 1.046 | 610 |
| BL50-8.5 | 17.52 | 756.6 | 675.4 | +1.56% | 59.4895 | 16.56 | 59.451 | 1.065 | 375 |
| BL-8.5-Gen. II | 20.65 | 847.3 | 764.8 | +16.76% | 66.5140 | 18.46 | 66.351 | 1.069 | 460 |

Various features of the invention are set forth in the following claims.

What is claimed is:

1. An impact tool comprising:

a housing;

a motor supported in the housing; and a drive assembly for converting a continuous torque input from the motor to consecutive rotational impacts upon a workpiece, the drive assembly including an anvil, a hammer that is both rotationally and axially movable relative to the anvil, a spring for biasing the hammer in an axial direction toward the anvil, a radially extending tab on one of the spring or the hammer, and a corresponding groove on the other of the spring or the hammer into which the radially extending tab is received, wherein the spring is rotationally unitized to the hammer for co-rotation therewith at all times during operation of the impact tool.

2. The impact tool of claim 1, wherein the corresponding groove defines a longitudinal axis parallel with a rotational axis of the hammer.

3. The impact tool of claim 2, wherein the hammer includes a recess in which the spring is at least partially received.

4. The impact tool of claim 3, wherein the corresponding groove is defined on the hammer and is located within the recess.

5. The impact tool of claim 1, wherein the radially extending tab is located on the spring.

6. The impact tool of claim 5, further comprising a plate attached to a first end of the spring and defining the radially extending tab.

7. The impact tool of claim 6, wherein the radially extending tab is a first of a plurality of radially outward extending tabs equally spaced on the plate, and wherein the corresponding groove is a first of a plurality of corresponding grooves equally spaced on the hammer in which the respective radially extending tabs are slidably received.

8. The impact tool of claim 1, wherein the spring includes a first end proximate the hammer, a second end opposite the first end, and a flat surface at the second end.

9. The impact tool of claim 8, further comprising a thrust bearing positioned at the second end of the spring to permit relative rotation between the motor and the spring.

10. The impact tool of claim 1, wherein the spring includes a spring moment of inertia and the hammer includes a hammer moment of inertia, and wherein the combined moments of inertia of the spring and the hammer is greater than $2.45\times10^{-4}$ kg-m$^2$.

11. An impact tool comprising:

a housing;

a motor supported in the housing; and a drive assembly for converting a continuous torque input from the motor to consecutive rotational impacts upon a workpiece, the drive assembly including:

an anvil, a hammer that is both rotationally and axially movable relative to the anvil, a spring for biasing the hammer in an axial direction toward the anvil, wherein the spring includes a first end proximate the hammer, a second end opposite the first end, and a flat surface positioned at the second end, a thrust bearing positioned at the second end of the spring to permit relative rotation between the motor and the spring, a tab on one of the spring or the hammer, and a corresponding groove on the other of the spring or the hammer into which the tab is received for rotationally unitizing the spring to the hammer.

12. The impact tool of claim 11, wherein the hammer includes a recess in which the spring is at least partially received.

13. The impact tool of claim 12, wherein the corresponding groove is defined on the hammer and is located within the recess.

14. The impact tool of claim 11, wherein the tab is located on the spring.

15. The impact tool of claim 14, further comprising a plate attached to a first end of the spring and defining the tab.

16. The impact tool of claim 11, wherein the spring includes a spring moment of inertia and the hammer includes a hammer moment of inertia, and wherein the combined moments of inertia of the spring and the hammer is greater than $2.45\times10^{-4}$ kg-m$^2$.

17. The impact tool of claim 11, wherein the tab is radially extending.

18. The impact tool of claim 11, further comprising a camshaft coupled to the motor, and wherein the thrust bearing is positioned between the second end of the spring and the camshaft.

* * * * *